United States Patent [19]

Steiniger

[11] 3,954,051

[45] May 4, 1976

[54] APPARATUS FOR CLIPPING WRAPPED ROD-LIKE FILLERS OF FIBROUS MATERIAL

[75] Inventor: Wolfgang Steiniger, Hamburg, Germany

[73] Assignee: Hauni-Werke Koerber & Co. KG, Hamburg, Germany

[22] Filed: Oct. 29, 1974

[21] Appl. No.: 518,738

[30] Foreign Application Priority Data

Dec. 7, 1973 Germany ..... 2361001

[52] U.S. Cl. ..... 93/77 FT; 83/316

[51] Int. Cl.[2] ..... A24C 5/50; B26D 1/56

[58] Field of Search ..... 131/65, 118; 83/316, 83/317, 315, 600; 93/1 C, 77 FT

[56] References Cited

UNITED STATES PATENTS

| | | | |
|---|---|---|---|
| 1,546,732 | 7/1925 | Hohn | 83/316 |
| 1,911,297 | 5/1933 | Balton | 131/65 X |
| 2,570,696 | 10/1951 | Levine | 83/600 X |
| 3,244,050 | 4/1966 | Pym | 131/65 UX |
| 3,631,749 | 1/1972 | Poupin | 131/65 X |
| 3,757,627 | 9/1973 | Lange | 83/600 X |

*Primary Examiner*—James F. Coan
*Attorney, Agent, or Firm*—Peter K. Kontler; John Kurucz

[57] ABSTRACT

Apparatus for separating the leader of a filter rod or cigarette rod intermediate the wrapping mechanism and the cutoff of a filter rod or cigarette rod making machine has a clipper which is pivotable by a fluid-operated or electric motor so that its blades move with the leader of the rod, and one or more cams which cause one or both blades of the moving clipper to move across the path for the rod and to thus separate the leader from the next-following portion of the rod before the leader reaches the cutoff. The leader, which is normally defective, is caused to descend into a collecting receptacle. The clipper severs the rod in a plane which is not normal to the axis of the rod so that the foremost part of the clipped rod has a slanting front end face and readily finds its way into the cutoff.

14 Claims, 6 Drawing Figures

APPARATUS FOR CLIPPING WRAPPED ROD-LIKE FILLERS OF FIBROUS MATERIAL

BACKGROUND OF THE INVENTION

The present invention relates to improvements in machines for the production of wrapped rod-like fillers which consist of fibrous material, particularly tobacco or filaments made of a synthetic plastic substance. More particularly, the invention relates to apparatus for trimming or clipping elongated rods of the type wherein a tubular wrapper made of cigarette paper, imitation cork, reconstituted tobacco, tobacco leaves or the like surrounds a rod-like filler consisting of comminuted tobacco or filter material. Still more particularly, the invention relates to apparatus for preventing the normally defective leader of a wrapped filler of tobacco or filter material from reaching the customary cutoff which subdivides the rod into plain cigarettes, cigarillos or cigars or into filter rod sections of unit length or multiple unit length. For the sake of simplicity, the invention will be described in connection with the making and processing of filter rod sections; however, the invention can be utilized with equal advantage in connection with the making of rod sections wherein a tubular wrapper surrounds a rod-like tobacco filler.

A machine for the making of filter rod sections has means for producing a continuous rod wherein a rod-like filler of filamentary material is surrounded by a tubular wrapper, a conveyor (e.g., the customary garniture) which advances the rod beyond the producing means, and a cutoff which severs the rod at predetermined intervals to convert it into a succession of filter rod sections of unit length or multiple unit length, normally six times unit length. When the machine is started, the leader of a fresh rod is often defective for a variety of reasons. For example, the seam of the wrapper is likely to be open, some of the filaments may extend beyond the front end of the wrapper, the front side of the rod is not smooth, or the leader is bent so that it is unlikely to find its way into the cutoff. Therefore, it is customary to separate the leader from the next-following portion of a fresh filter rod to thus insure that the cutoff begins to subdivide that portion of the fresh rod which exhibits all desirable characteristics as regards its appearance, resistance to the flow of tobacco smoke, diameter and/or others.

In presently known filter rod making machines, an attendant observes the leader of a fresh filter rod and directs it into a collecting receptacle. When the attendant assumes that the characteristics of the fresh rod are satisfactory, the leader is separated and the foremost part of the next-following portion (i.e., the new leader) of the fresh rod is permitted or caused to enter the cutoff. Separation of the leader from the next-following portion of the fresh rod is effected by breaking off or by manually severing the rod. Such operation is time-consuming because an attendant must be stationed at the filter rod making machine whenever the machine is started and, moreover, the attendant must be skilled as well as agile in order to insure proper separation of the leader of a rapidly advancing rod as well as the introduction of the new leader into the cutoff. If the new leader misses the inlet of the cutoff or bypasses the guide which cooperates with the cutoff, the rod is likely to break or buckle upstream of the cutoff so that the entire machine must be arrested with attendant losses in output. Such losses arise not only as a result of stoppage of the machine but also because the leader of the rod which is being produced when the machine is started anew must be separated again since it is likely to be defective for one or more of the aforementioned reasons.

SUMMARY OF THE INVENTION

An object of the invention is to provide a novel and improved apparatus for automatic or semiautomatic separation of the leader of a fresh rod in a machine for the production of wrapped rod-like fillers consisting of tobacco or filter material.

Another object of the invention is to provide a novel and improved trimming or clipping apparatus which can be installed in existing machines for the production of filter rods or tobacco-containing rods.

A further object of the invention is to provide a clipping or trimming apparatus which can separate the leader of a fresh rod without any assistance on the part of the operator in automatic response to starting of the rod making machine.

An additional object of the invention is to provide an apparatus which can remove the leader in such a way that the next-following portion of the clipped rod automatically finds its way into the next processing station, such as the station where a cutoff or an analogous severing device subdivides the rod into sections of desired length.

Still another object of the invention is to provide a simple and compact clipping or trimming apparatus which can be installed in or on a rod making machine to occupy space which is available in such machine intermediate the rod producing and subdividing means.

The invention resides in the provision of an apparatus which can be utilized in a machine having means for producing a continuous rod wherein a rod-like filler of fibrous material is surrounded by a tubular wrapper, means for conveying the rod lengthwise beyond the producing means so that the rod advances in a predetermined direction and along a predetermined path, and means for severing the rod at predetermined intervals downstream of the producing means to thereby subdivide the rod into sections of desired length, e.g., into plain cigarettes, cigarillos or cigars of unit length or into filter rod sections of multiple unit length. The apparatus is utilized to separate the (normally defective) leader from the next-following (satisfactory) portion of the rod intermediate the producing means and the severing means and comprises a cutting instrument or implement (preferably a clipper or scissors) having at least one blade, means for transporting the blade with the rod which is being advanced by the conveying means so that the blade has a component of movement in the aforementioned direction, and means for moving the blade across the path for the rod so that the blade separates the leader from the next-following portion of the rod while the blade is being moved by the transporting means.

The blade or blades of the cutting implement are preferably movable by the transporting means (this transporting means may include a fluid-operated or electric motor which pivots the implement about a predetermined axis) from a predetermined starting position, and the apparatus preferably further comprises means for actuating the transporting means and the blade moving means in response to advancement of the leader of a rod beyond the blade or blades of the cutting implement (while the blade or blades dwell in the starting position) but short of the severing means. It is preferred to clip or trim the rod by cutting it in a plane which is not normal to the axis of the rod so that the front end face of the trimmed rod is inclined and is thus more likely to find its way into the range of the severing means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
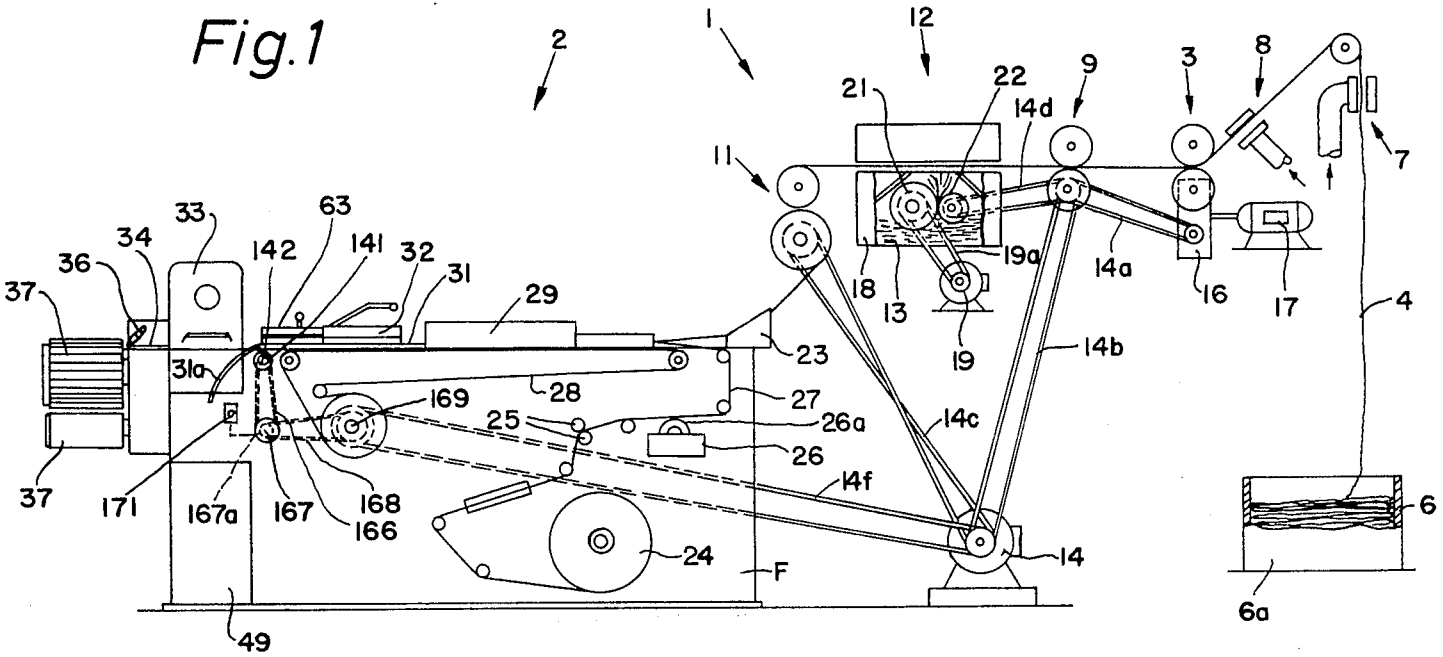
FIG. 1 is a schematic partly elevational and partly sectional view of a filter rod making machine which includes a clipping or trimming apparatus embodying one form of the invention.

FIG. 1 shows a filter rod making machine of the type known as KDF produced by Hauni-Werke, Körber & Co. KG., of Hamburg-Bergedorf, Western Germany. The machine comprises means for producing a continuous filter rod 31, means 33 for severing the rod 31 at predetermined intervals so as to subdivide the rod into sections 34 of desired length (e.g., six times unit length), and rod conveying means 28 which, in the embodiment of FIG. 1, forms part of the producing means and serves to advance the rod 31 in a direction to the left, along a horizontal path, and into the range of the knife or knives of the severing means 33.

The producing means of the filter rod making machine comprises a conditioning unit 1 for a tow 4 of crimped filamentary filter material and a filter rod forming unit 2 which follows the conditioning unit, as considered in the direction of lengthwise movement of the tow. The tow 4 is stored in the form of a bale 6 which is placed into a container 6*a*. The conditioning unit 1 comprises a first pair of advancing rolls 3 which draw the tow 4 from the bale 6 whereby the tow advances through two conventional banding devices 7, 8 which preferably operate with streamlets of compressed air and serve to loosen the filaments of the tow so that the latter can be converted into a flat layer not later than while its increments advance between a second pair of advancing rolls 9 and a third pair of advancing rolls 11. The peripheral speed of the advancing rolls 9 exceeds that of the advancing rolls 3 so that the filaments of the tow 4 are stretched in the region between the rolls 3 and 9, i.e., the crimp of the filaments disappears or is reduced to an extent which can be regulated by controlling the speed of the rolls 3. In this manner, the machine determines the quantity of filter material per unit length of the filter rod 31. The lower roll 3 is driven by the output element of a variable-speed transmission 16 whose input element is driven by an endless belt or chain 14*a* receiving motion from the main prime mover 14 (e.g., an electric motor) of the machine. The ratio of the transmission 16 can be changed by a motor 17. The motor 14 further drives two additional belts or chains 14*b*, 14*c* which respectively transmit torque to the lower roll 9 and the lower roll 11. The belt or chain 14*a* is driven by a pulley or sprocket wheel on the shaft of the lower roll 9.

The peripheral surface of one of the rolls 9 and 11 is preferably provided with circumferential grooves and the other roll of the pairs of rolls 9 and 11 is preferably provided with a smooth peripheral surface constituting the outer surface of an elastic sleeve which surrounds a rigid core or hub of the respective roll.

That portion of the tow 4 which travels between the advancing rolls 9 and 11 preferably forms a flat layer wherein the filaments are substantially parallel to and are not interlaced with each other. Such portion of the two moves through a spraying device 12 which comprises a vessel 18 for a supply of plasticizer 13, a roller 21 which is mounted in the vessel 18 and dips into the supply of plasticizer, a motor 19 which drives the roller 21 so that the peripheral surface of the roller 21 withdraws a thin film or plasticizer, and a rotary brush 22 which atomizes the thin film of plasticizer and propels the particles of plasticizer against the filaments of the tow 4 between the advancing rolls 9 and 11. When the placticizer sets, its particles bond portions of the neighboring filaments to each other not later than when the filter rod sections 34 reach the next processing station (e.g., a filter cigarette making machine, not shown) to thus enhance the rigidity of the sections 36 as well as their ability to offer a predetermined resistance to the flow of tobacco smoke and to intercept a high percentage of deleterious ingredients. The motor 19 drives the roller 21 through the medium of a chain or belt 19*a*, and the lower advancing roll 9 drives the brush 22 through the medium of a chain or belt 14*d*.

The rod forming unit 2 of the filter rod making machine comprises a customary gathering horn 23 which receives successive increments of the tow 4 and converts the tow into a rod-like filler which enters a wrapping mechanism 29. The mechanism 29 includes the aforementioned transporting means 28 which is an endless belt known as garniture and moves the filler lengthwise together with a web 27 of wrapping material, e.g., cigarette paper, imitation cork or the like. The web 27 is being withdrawn from a bobbin 24 which is mounted in the frame F of the filter rod making machine. The frame F further supports two advancing rolls 25 at least one of which is driven by the motor 14 in a manner not shown in FIG. 1. The rolls 25 feed the web toward the right-hand end of the upper stretch of the garniture 28 whereby the underside of the web contacts a rotary applicator 26*a* forming part of a paster 26 which includes a tank for a supply of suitable adhesive (e.g., a wet adhesive or a so-called hot melt).

The wrapping mechanism 29 cooperates with the upper stretch of the garniture 28 to drape the web 27 around the rod-like filler of fibrous material so that the filler and the web form the aforementioned filter rod 31. The seam of the tubular wrapper which is obtained in response to draping of the web 27 around the filler is heated by a customary sealer 32 so that the seam does not burst open during severing of the rod by the knife or knives of the severing means 33. The latter may constitute a conventional cutoff wherein the knife or knives move with the rod while the rod is being severed to yield successive filter rod sections 34 of desired length. Such sections are accelerated by a rapidly rotating cam 36 which propels them into successive flutes of a rotary drum-shaped row forming conveyor 37 serving to convert the single file of sections 34 into one or more rows of sections which move sideways and are deposited onto the upper stretch of an endless take-off belt 37. The latter can transport the sections 34 into storage, to a pneumatic sender which propels them into the magazine of a filter cigarette making machine, or directly into the magazine of a filter cigarette making machine.

It will be noted that the left-hand portion of the upper stretch of the garniture 28 extends beyond the wrapping mechanism 29 and beyond the sealer 32 so that it can advance the rod 31 toward and close to the cutoff 33. When the machine of FIG. 1 is started, the front end portion or leader 31*a* of the rod 31 is normally defective or is likely to be defective. Therefore, such leader should be separated from the next-following (satisfactory) portion of the rod 31 in order to insure that each section 34 will be satisfactory for further processing, not only as regards its appearance and diameter but also as regards its resistance to the flow of tobacco smoke and its ability to intercept a large percentage of deleterious ingredients of tobacco smoke. To this end, the filter rod making machine is combined with a novel apparatus which is used to trim or clip the rod 31 by separating therefrom the defective or potentially defective leader 31*a* before the latter reaches the cutoff 33. The separated leader 31*a* is caused or permitted to descend into a collecting or intercepting receptacle 49 as shown in FIG. 1 at a level below the cutoff 33.

Figures 2, 3:
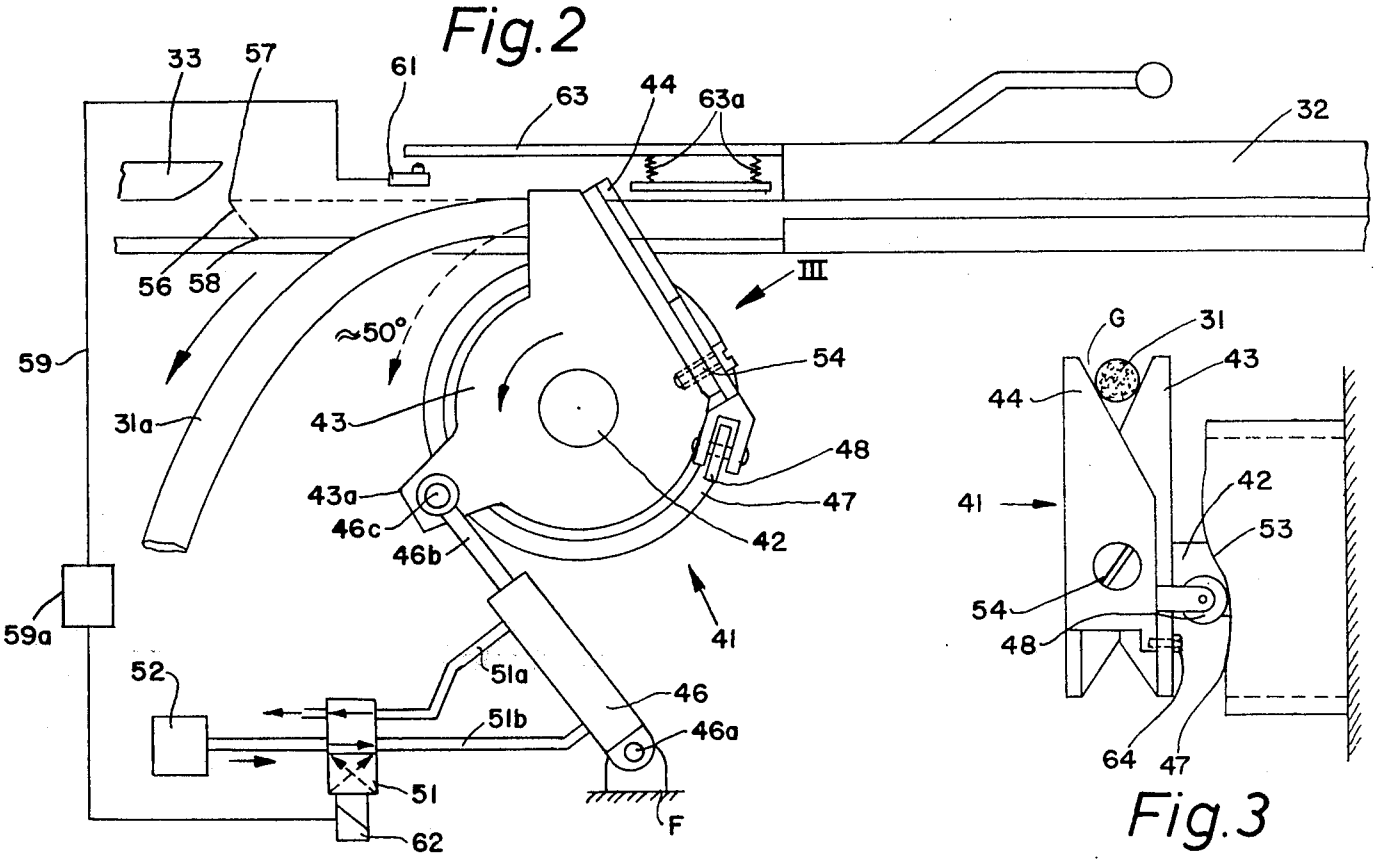
FIG. 2 illustrates a portion of the machine of FIG. 1 and a second trimming apparatus.
FIG. 3 is a view as seen in the direction of arrow III in FIG. 2.

Prior to describing the clipping or trimming apparatus of FIG. 1, reference will be had to FIGS. 2 and 3 which show on a larger scale the details of a second trimming apparatus. This second apparatus comprises a cutting instrument or implement 41 which is a clipper or scissors having two blades 43, 44 at least one of which (e.g., the blade 44) is pivotable with respect to the other blade about the shank of a pivot member 54 here shown as a screw meshing with the blade 43. The clipper 41 is mounted between the sealer 32 and the cutoff 33 of the filter rod making machine and is turnable about the axis of a shaft 42 which is fixedly mounted in the frame F. The means for transporting the clipper 41 from the starting position of FIG. 2 towards a second end position (not shown) in which the blades 43, 44 are spaced apart from the path for the rod 31 includes a fluid-operated motor 46 here shown as a double-acting pneumatic cylinder and piston unit which is secured to the frame F by a pivot 46*a* and has a piston rod 46*b* connected to a lug 43*a* of the blade 43 by a pin 46*c*. When the piston rod 46*b* is retracted into the cylinder of the motor 46, the clipper 41 turns counterclockwise, as viewed in FIG. 2, whereby each of its blades 43, 44 has a component of movement in the direction of lengthwise movement of the rod 31. The speed at which the motor 46 turns the clipper 41 from the starting position of FIG. 2 equals or exceeds the speed of lengthwise movement of the rod 31 toward the cutoff 33. For example, the motor 46 can move the clipper 41 through an angle of approximately 50°.

The apparatus of FIGS. 2 and 3 further comprises means for moving the blade 44 across the path for the rod 31 while the clipper 41 pivots counterclockwise whereby the cutting edge of the blade 44 cooperates with the cutting edge of the blade 43 to separate the leader 31*a* from the next-following portion of the rod 31 and the separated leader drops into a collecting receptacle, such as the receptacle 49 of FIG. 1. The means for moving the blade 44 relative to the blade 43 comprises a stationary cam 47 and a roller follower 48 which is mounted on the blade 44 and tracks a suitably configurated face of the cam 47. The clipper 41 may comprise one or more springs (not shown) which permanently bias the follower 48 against the face of the cam 47. A rise or slope 53 of the cam face causes the blade 44 to pivot with respect to the blade 43 while the clipper 41 turns about the axis of its shaft 42 so that the blades 43, 44 cut across the rod 31 and separates the leader 31*a* while the blades have a component of movement which is parallel to the direction of movement of the rod 31 toward the cutoff 33. The separation of leader 31*a* takes place before the latter can reach the cutoff 33. As shown in FIG. 2, the leader 31*a* may be improperly filled with filamentary filter material, or the seam of its wrapper may be open so that the leader flexes under the action of gravity and bypasses the cutoff 33.

The cam 47 is a hollow cylinder which is coaxial with and spacedly surrounds the shaft 42 for the clipper 41. The roller follower 48 tracks the left-hand end face of the cam 47, as viewed in FIG. 3.

The operation of the apparatus which includes the clipper 41 of FIGS. 2 and 3 is as follows.

The machine starts to produce a fresh filter rod 31 in response to starting of the motor 14 of FIG. 1. The leader 31*a* of such filter rod advances beyond the sealer 32. The clipper 41 dwells in the starting position of FIGS. 2 – 3 and its blades 43, 44 are sufficiently spaced apart (see FIG. 3) to allow the leader 31*a* of the fresh rod 31 to pass therebetween. If necessary, the leader 31*a* may be deflected by hand so that it bypasses the cutoff 33 and advances toward the receptacle 49. When the length of the leader 31*a* is sufficient to warrant the assumption that the next-following portion of the rod 31 is satisfactory in all respects, the motor 46 is caused to turn the clipper 41 counterclockwise, as viewed in FIG. 2, whereby the roller follower 48 travels along the adjacent end faces of the stationary cam 47 and causes the movable blade 44 to move across the path for the rod 31 as soon as the follower 48 reaches the rise 53. Thus, the separation of leader 31*a* takes place in automatic response to turning of the clipper 41 about the axis of the shaft 42. The actuating means which initiates the pivotal movement of clipper 41 from the starting position of FIG. 2 includes a regulating valve 51 which is interposed between a source 52 of pressurized fluid and the chambers of the cylinder of the motor 46. When the motor 46 maintains the clipper 41 in the starting position of FIG. 2, the valve 51 allows a first conduit 51*a* to connect the upper chamber of the cylinder with the atmosphere (the pressurized fluid is assumed to be air) while a second conduit 51*b* admits pressurized fluid from the source 52 into the lower chamber of the cylinder. Thus, the piston rod 46*b* is maintained in its extended position. When the attendant wishes that the motor 46 turn the clipper 41 counterclockwise, a solenoid 62 is energized to move the spool of the valve 51 to a second position in which the conduit 51*a* communicates with the source 52 and the conduit 51*b* communicates with the atmosphere. The piston rod 46*b* is retracted into the cylinder of the motor 46 and the clipper 41 turns anticlockwise whereby the cam 47 automatically pivots the blade 44 about the axis of the screw 54 and effects a separation of the leader 31*a* which drops into the receptacle 49. The next-following portion of the rod 31 is straight and advances into the range of the knife or knives of the cutoff 33 which severs the rod at predetermined intervals so that the rod is converted into a single file of filter rod sections 34.

In accordance with a feature of the invention, the cutting edges of the blades 43, 44 sever the rod 31 in a plane which is not normal to the axis of the rod. This is shown in FIG. 2 wherein the inclined front end face of the trimmed or clipped rod 31 is indicated by the character 56. This front end face has an upper portion 57 which extends well beyond its lower portion 58 so that the new leader of the clipped rod 31 resembles a wedge which can automatically thread itself into the customary guide wherein the rod advances during severing by the knife or knives of the cutoff 33. The cutting edges of the blades 43, 44 can sever the rod 31 shortly or immediately after the clipper 41 leaves the starting position of FIG. 2, i.e., the inclination of cutting edges of the blades 43, 44 during severing of the rod need not appreciably exceed the inclination shown in FIG. 2.

The valve 51 maintains the piston rod 46*b* in the retracted position when the clipper 41 reaches its second end position (after having been pivoted through approximately 50° in a counterclockwise direction, as viewed in FIG. 2). This insures that the blades 43, 44 do not interfere with movement of the clipped rod 31 toward the cutoff 33. The solenoid 62 is deenergized when the filter rod making machine is arrested whereby the conduit 51*a* again communictes with the atmosphere and the conduit 51*b* communicates with the source 52 to thus return the piston rod 46*b* to the extended position of FIG. 2. The blades 43, 44 are held apart (FIG. 3) so that they provide room for the leader of a fresh rod which is to be produced in response to renewed starting of the motor 14.

The solenoid 62 can be energized and deenergized in automatic response to movement of a protective cover or shroud 63 which overlies the path for the rod 31 downstream of the sealer 32 and prevents injury to the attendant by the cutting edges of the blades 43, 44 when the clipper 41 dwells in the starting position and/or when the clipper 41 turns in response to starting of the motor 46 in order to pivot the blades 43 and 44 counterclockwise. The shroud 63 can be pivoted to an open position when the machine is stopped and back to the illustrated closed position when the machine is started. This actuates an electric switch 61 which is connected with the solenoid 61 by conductor means 59. The conductor means 59 may contain a suitable time-delay device 59 (e.g., a relay which delays the energization of solenoid 62 in response to closing of the shroud 63 whereby such delay suffices to insure that the defective front portion (leader 31*a*) of the rod 31 has been advanced beyond the blades 43, 44 of the clipper 41 before the motor 46 begins to pivot the clipper from the starting position of FIG. 2. The time-delay device 59*a* is preferably adjustable so as to enable the attendant to change the length of the interval during which the motor 46 remains idle subsequent to return movement of the shroud 63 to its closed position, i.e., in response to starting of the motor 14. At any rate, the delay with which the motor 46 begins to pivot the clipper 41 counterclockwise in response to starting and subsequent rotation of the motor 14 at a normal operating speed should be sufficient to invariably insure that the blades 43, 44 separate a leader 31*a* which is long enough to guarantee that the next-following portion of the rod 31 is satisfactory in all respects.

When the motor 14 is arrested again, i.e., when the filter rod making machine is stopped, the shroud 63 is lifted by the attendant or automatically (e.g., in response to disengagement of a lock which allows the springs 63*a* shown in FIG. 2 to lift the shroud above and away from the switch 61) whereby the motor 46 returns the clipper 41 to the starting position. As stated before, the speed of pivotal movement of the clipper 41 from its starting position equals or exceeds the speed of lengthwise movement of the rod 31 towards the cutoff 33. For example, the speed of pivotal movement of the clipper 41 may be such that the blades 43, 44 move transversely of but simultaneously move forwardly at the speed of the rod 31 while the piston rod 46*b* is being retracted into the cylinder of the motor 46.

FIG. 3 further shows a screw 64 which can be rotated to effect a precise adjustment of the angular position of movable blade 44 with respect to the stationary blade 43. The term "stationary" as used in connection with the blade 43, is intended to denote that this blade does not move across the path for the rod 31 but it does not exclude the movement of blade 43 about the axis of the shaft 42. By rotating the adjusting screw 64, an attendant can change the width of the gap G between the cutting edges of the blades 43, 44 (see FIG. 3) so that the clipper 41 can be set to sever filter rods having different diameters.

The placing of the cam 47 as close to the shaft 42 as possible is desirable because this allows for a reduction of the length and hence of the bulk and inertia of the pivotable blade 44 and of the entire clipper 41. Therefore, the cam 47 is preferably a hollow cylinder cam which is coaxial with and surrounds the shaft 42 and one end face of which constitutes the cam face for the roller follower 48.

Since the speed of pivotal movement of the clipper 41 about the axis of the shaft 42 at least equals the speed of the rod 31, the blades 43, 44 can be moved out of the way immediately after separation of the leader 31*a*. In order to avoid the need for accurate synchronization of movements of the clipper 41 and rod 31, the speed of pivotal movement of the clipper 41 may exceed the speed of lengthwise movement of the rod.

Referring again to FIG. 1, there is shown a modified apparatus which can separate the leader 31*a* from the next-following portion of the filter rod 31. This apparatus comprises a scissors or clipper 141 which is rotatable through 360° about the axis of a horizontal shaft 142 mounted in the frame F. The shaft 142 carries a pulley or sprocket wheel which can be driven by an endless belt or chain 166. The means for driving the belt or chain 166 comprises a second pulley or sprocket wheel on a drive shaft 167 which is also mounted in the frame F and can transmit torque to the second pulley or sprocket wheel through the medium of a clutch 167*a*. The shaft 167 is driven by a belt or chain 168 which is driven by a shaft 169 mounted in the frame F and receiving motion from the motor 14 via belt or chain 14*f*. The shaft 169 further serves to drive one of the pulleys for the garniture 28.

The clutch 167*a* is engaged when the blades of the clipper 41 are to sever the rod 31 so as to separate the leader 31*a* which then descends into the receptacle 49. The means for engaging the clutch 167*a* comprises a relay 171 which is mounted on the frame F and can be energized by depressing a pushbotton or the like. However, the relay 171 can also be energized in response to closing of the shroud 63, i.e., in response to starting of the motor 14. The relay 171 is preferably a self-deenergizing time-delay relay which can engage the clutch 167*a* with a predetermined or variable delay following the movement of shroud 63 to the closed position and is deenergized at the exact moment when the clipper 141 completes a full revolution about the axis of the shaft 142. Thus, the chain 166 invariably returns the clipper 141 to the starting position of FIG. 1 before the relay 171 is deenergized to disengage the clutch 167*a* and to thus disconnect the chain 166 from the motor 14. While the clipper 141 rotates counterclockwise, as viewed in FIG. 1, at least one of its blades (not specifically shown) is caused to move across the path for the rod 31 so that the leader 31*a* is separated from the next-following (satisfactory) portion of the rod and such portion can advance into the range of the knife or knives of the cutoff 33. The means for moving one or both blades of the clipper 141 across the path for the rod 31 may comprise cam and follower means similar to the parts 47, 48 shown in FIGS. 2 and 3.

The operation of the apparatus of FIG. 1 is as follows.

When the filter rod making machine is started by starting the motor 14, the attendant depresses the aforementioned pushbutton or closes the shroud 63 to connect the relay 171 with a source (not shown) of electrical energy. The relay 171 is energized with a fixed or variable delay reassumes engage the clutch 167*a* at a time when the length of the leader 31*a* is sufficient to justify its separation from the next-following portion of the rod 31 which advances toward the cutoff 33. The clutch 167*a* causes the belt or chain 166 to rotate the clipper 141 whereby the latter separates the leader 31*a* while its blades move counterclockwise about the axis of the shaft 142. The relay 171 is deenergized and automatically disengages the clutch 167*a* when the clipper 141 completes a full revolution, i.e., when it resumes the starting position of FIG. 1. The construction of the aforementioned (cam and follower) means for moving one or both blades of the clipper 141 across the path for the rod 31 is such that the blades are spaced apart in a manner as shown for the blades 43, 44 of FIG. 3 not later than when the clipper 141 reassumes the starting position of FIG. 1. This insures that the satisfactory parts of the rod 31 can advance between the blades of the clipper 141 to be severed by the knife or knives of the cutoff 33. The speed of movement of blades of the clipper 141 in a direction toward the cutoff 33 equals or exceeds the speed of lengthwise movement of the rod 31. This insures the making of clean cuts between the leader 31*a* and the next-following portion of the rod 31.

The clipper 141 then remains in the starting position of FIG. 1 and is caused to rotate again after the motor 14 is stopped and after the motor 14 is thereupon restarted to initiate the making of a fresh rod whose leader must be separated before it enters the cutoff. The rotary movement of clipper 141 is initiated again by depressing the aforementioned button or by closing the shroud 63 in response to or simultaneously with starting of the motor 14.

An advantage of the apparatus of FIG. 1 is that the clipper 141 leaves its starting position only for a very short interval of time which is necessary to cause the clipper to complete a full revolution about the axis of the shaft 142. Thus, the attendant need not be concerned with the return movement of clipper 141 to the starting position before the machine is started again because the clipper invariably occupies such starting position when the machine is arrested as well as when the machine is started. The apparatus of FIGS. 2 and 3 is somewhat simpler and is preferred in machines wherein minor lateral deflections of the rod 31 (as a result of pivotal movement of the blade 44 relative to the stationary blade 43) during separation of the leader 31*a* are of no consequence. Furthermore, the apparatus of FIGS. 2 – 3 exhibits the advantage that the blades 43, 44 are invariably out of the way when the satisfactory portion of a rod 31 advances toward the cutoff 33 because the clipper 41 then dwells in its second end position. This is especially desirable when the wrapper of the rod 31 is highly sensitive so that it is important to avoid accidental contact between the wrapper and the blade or blades of the clipper in starting position.

Figure 6:
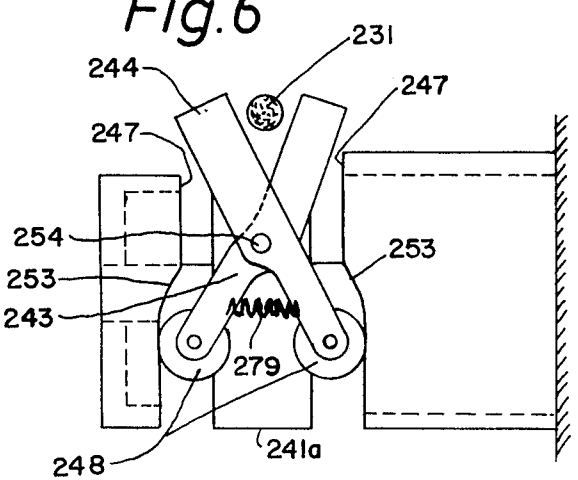
FIG. 6 is a view as seen in the direction of arrow VI in FIG. 4.
Figure 5:
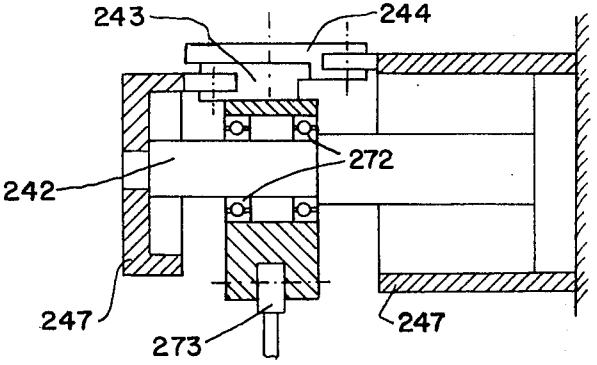
FIG. 5 is a sectional view of the third trimming apparatus.
Figure 4:
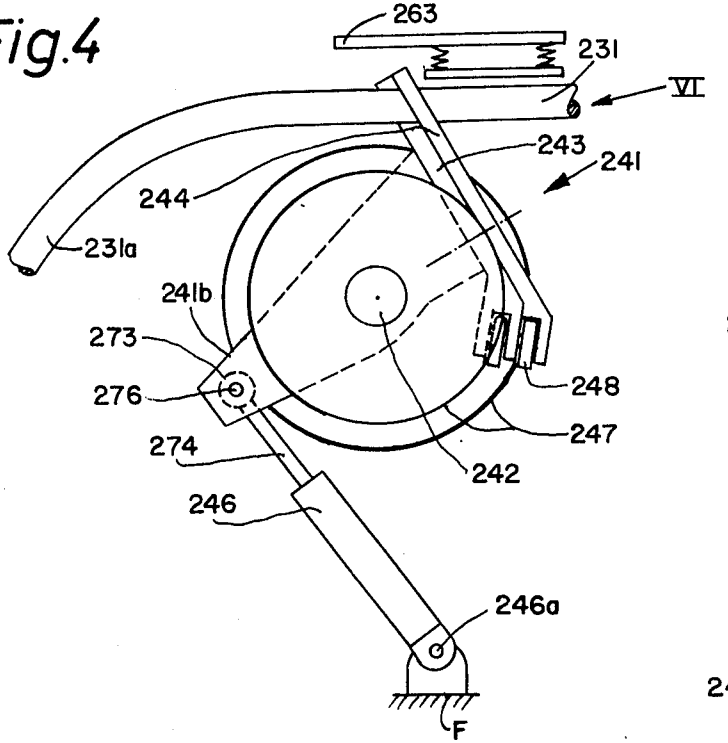
FIG. 4 is an elevational view of a third trimming apparatus.

FIGS. 4 to 6 show a third embodiment of the improved apparatus. All such parts of this apparatus which are identical with or clearly analogous to the apparatus of FIGS. 2 – 3 are denoted by similar reference characters plus 200. The clipper 241 is constructed in such a way that the rod 231 is severed while the axis of the rod is located in a common vertical plane with the axis of the pivot 254. Furthermore, the clipper 241 has two pivotable blades 243, 244 which resemble two-armed levers each having a cutting edge on its upper arm and a roller follower 248 on its lower arm. The roller followers 248 track the faces of two discrete stationary cams 247 which are substantially mirror symmetrical to each other with reference to the aforementioned common vertical plane of the axes of pivot 254 and rod 231. The entire clipper 241 is pivotable about the axis of the shaft 242 in the same way as described for the clipper 41, i.e., the blades 243, 244 leave their starting positions shown in FIG. 4 and turns about the shaft 242 in a counterclockwise direction whereby the roller followers 248 travel along the sloping portions 253 of the respective cam faces and cause the blades 243, 244 to turn about the axis of the pivot 254 to thereby separate the leader 231*a* from the next-following portion of the rod 231. The clipper 241 has a carrier 241*a* which supports the pivot 254 for the blades 243, 244 and is mounted on antifriction bearings 272 which surround the shaft 242. A spring 279 is provided to bias the lower legs of the blades 243, 244 away from each other and to thus maintain the roller followers 248 in permanent contact with the faces of the respective cams 247. The diameter of the cam 247 for the roller follower 248 of the blade 243 is somewhat smaller than that of the cam 247 for the roller follower 248 of the blade 244 because the blade 244 overlies the blade 243, see FIGS. 4 and 6. Thus, the diameter of endless path defined by the face of the left-hand cam 247 of FIG. 6 is smaller than the diameter of the endless path which is defined by the face of the right-hand cam (see FIG. 5). This is accounted for by appropriate positioning of sloping portions 253 on the respective cam faces.

The motor 246 includes a double-acting fluid-operated cylinder which is articulately connected to the machine frame F by a pivot pin 246*a* and has a piston rod 274 which is provided with a strap 273 surrounding a pivot pin 276 on a lug 241*b* of the carried 241*a*. The means for actuating the motor 246 is not shown in the drawing; such means may include the shroud 263 which is shown in FIG. 4.

The apparatus of FIGS. 4 – 6 exhibits the advantage that the clipper 241 does not deflect the rod 231 sideways or otherwise while the rod is being severed to separate the leader 231*a*. This is due to the fact that the clipper 241 comprises two pivotable blades which approach the moving rod from opposite sides (see FIG. 6) so that the rod remains in the predetermined path leading directly toward the cutoff while the cutting edges of the blades 243, 244 cooperate to separate the leader 231*a*.

The operation of the apparatus of FIGS. 4 to 6 is as follows.

When the main prime mover of the filter rod making machine is started, the leader 231*a* of a fresh rod 231 advances beyond the sealer (not shown) and is flexed, either automatically or by hand, so that it bypasses the cutoff and advances toward the collecting receptacle. The motor 246 is actuated with a predetermined delay to insure that the leader 231*a* is long enough to warrant the assumption that the next-following portion of the rod 231 is satisfactory and can be permitted to reach the cutoff. The motor 246 then retracts its piston rod 274 to pivot the clipper 241 counterclockwise, as viewed in FIG. 4, whereby the cams 247 cause the blades 243, 244 to pivot their cutting edges toward each other as soon as the roller followers 248 begin to track the sloping portions 253 of the respective cam face. The separated leader 231*a* descends into the receptacle and the trimmed rod 231 is permitted to advance toward the cutoff. The clipper 241 thereupon remains in a second end position in which the blades 243, 244 are located below the path for the rod 231 as long as the filter rod making machine remains in operation. When the machine is arrested, the motor 246 is actuated to return the clipper 241 to the starting position of FIG. 4 whereby the spring 279 insures that the upper arms of the blades 243, 244 are spaced apart to permit entry of the leader of a fresh rod as soon as the main prime mover of the machine is restarted. The motor 246 is thereupon again started with a certain delay and causes the blades 243, 244 to separate the leader from the next-following portion of the fresh rod.

It is clear that the apparatus of FIGS. 4 to 6 can be modified to more closely resemble the apparatus of FIG. 1. Thus, the clipper 141 of FIG. 1 can be replaced with the clipper 241 or with an analogous clipper which comprises two movable blades and automatically returns to its starting position by pivoting through 360° whenever it becomes necessary to sever the leader of a fresh rod.

It is further within the purview of the invention to mount the clipper of the improved apparatus on a carriage which is reciprocable in parallelism with the rod between the wrapping mechanism and the cutoff. The apparatus then comprises means which opens the clipper not later than when the clipper returns to the starting position, means which moves the carriage and the clipper in the same direction as and at the speed of the rod when the rod making machine is started, and means for causing the clipper to separate the leader from the rod. However, the illustrated pivotal mounting of the clipper is preferred at this time because the clipper can move its blades out of the way subsequent to separation of the leader whereas the just described modified apparatus must comprise means for accelerating the clipper subsequent to separation of the leader so that the clipper cannot interfere with movement of the next-following portion of the rod toward the cutoff, and means for withdrawing the blades of the clipper from the path for the rod not later than immediately upstream of the cutoff. This normally necessitates the utilization of complex controls which contribute significantly to the cost of the apparatus and render it more prone to malfunction. Also, an apparatus having a reciprocable clipper necessitates more room than an apparatus with a clipper which is turnable about a fixed axis.

An important advantage of the improved apparatus is that it relieves the operators in a tobacco processing plant because the leaders of fresh rods are segregated from the next-following portions of the rods with a minimum of attention on the part of operators or in a fully automatic way. Moreover, the apparatus occupies room which is readily available in a machine for making of filter rods or tobacco-containing rods, and its shroud protects the attendants for injury. Still further, the blades of the clipper are capable of making a clean cut and of configurating the front portion of the satisfactory part of a fresh rod in such a way that the rod is more likely to thread itself into the cutoff.

If the apparatus is caused to separate the leader of a fresh rod in a fully automatic way, i.e., whenever the operating condition of the machine necessitates such separation, a single attendant can supervise the operation of an entire battery of rod making machines or a series of complete production lines each of which comprises one or more rod making machines, for example, production lines wherein a filter rod making machine and a cigarette rod making machine respectively supply filter rod sections and plain cigarettes to a filter cigarette making machine and wherein the output of the filter cigarette making machine is fed directly into a packing machine.

Without further analysis, the foregoing will so fully reveal the gist of the present invention that others can, by applying current knowledge, readily adapt it for various applications without omitting features which fairly constitute essential characteristics of the generic or specific aspects of my contribution to the art and, therefore, such adaptations should and are intended to be comprehended within the meaning and range of equivalence of the claims.

What is claimed as new and desired to be protected by Letters Patent is set forth in the appended claims.

1. In a machine having means for producing a continuous rod wherein a rod-like filler of fibrous material is surrounded by a tubular wrapper, means for conveying the rod lengthwise along a predetermined path and in a predetermined direction, and means for severing the rod at predetermined intervals downstream of said producing means to thereby subdivide the rod into sections of desired length, the improvement which consists in the provision of an apparatus for separating the leader from the next-following portion of the rod intermediate said producing means and said severing means, said apparatus comprising a cutting implement having two blades and being turnable about a predetermined axis; means for transporting said blades so that said blades have a component of movement in said direction; and means for moving at least one of said blades across said path so that said blades separate the leader from the next-following portion of the rod while said blades are being moved by said transporting means, said transporting means comprising a device for turning said implement about said axis and said moving means comprising a cam which surrounds said axis and is tracked by follower means provided on said one blade so that said one blade moves across said path while said implement turns about said axis.

2. Apparatus as defined in claim 1, wherein said blades are movable from a predetermined starting position, and further comprising means for actuating said transporting means and said moving means in response to advancement of the leader of a rod beyond said blades in said starting position thereof.

3. Apparatus as defined in claim 1, wherein said path is a straight path and said moving means is arranged to move said one blade across said path while said one blade makes an oblique angle with the direction of movement of the rod along said path so that, upon separation of said leader, the next-following portion of the rod has a front face which makes an oblique angle with the axis of the rod.

4. Apparatus as defined in claim 1, wherein said cam is a hollow cylinder having an axis which coincides with said predetermined axis and an end face which is tracked by said follower means.

5. Apparatus as defined in claim 1, wherein said device comprises means for moving said implement at a speed which equals or closely approximates the speed of movement of the rod along said path.

6. Apparatus as defined in claim 1 for use in a machine which further comprises a prime mover, wherein said device comprises a rotary shaft, means for rotating said shaft in response to starting of said prime mover, and means for transmitting torque from said shaft to said turnable implement.

7. Apparatus as defined in claim 1, wherein said device comprises a motor which is actuatable to turn said implement about said axis.

8. Apparatus as defined in claim 1, wherein said device comprises means for moving said implement at a speed which exceeds the speed of movement of the rod along said path.

9. Apparatus as defined in claim 1, wherein said blades include a movable blade which constitutes said one blade and a stationary blade which cooperates with said movable blade to separate the leader from the next-following portion of the rod while said blades are being moved by said transporting means.

10. Apparatus as defined in claim 1, wherein said device comprises means for rotating said implement through 360° about said predetermined axis from and back to a starting position in which said blades define a gap for the passage of the rod therebetween.

11. Apparatus as defined in claim 1, for use in a machine having a prime mover, wherein said blades are a clipper movable by said transporting means back and forth to and from a starting position in which said blades define a gap for the passage of the rod therebetween.

12. Apparatus as defined in claim 11, further comprising means for actuating said transporting means so that said blades are held away from said starting position while said next-following portion of the rod is being subdivided by said severing means and said blades are returned to said starting position in response to stoppage of said prime mover.

13. In a machine having means for producing a continuous rod wherein a rod-like filler of fibrous material is surrounded by a tubular wrapper, means for conveying the rod lengthwise along a predetermined path and in a predetermined direction, and means for severing the rod at predetermined intervals downstream of said producing means to thereby subdivide the rod into sections of desired length, the improvement which consists in the provision of an apparatus for separating the leader from the next-following portion of the rod intermediate said producing means and said severing means, said apparatus comprising a cutting implement having two blades, said blades having pivotable relative to each other and said implement being turnable about a predetermined axis; means for transporting said blades so that said blades have a component of movement in said direction, said transporting means comprising a device for turning said implement about said axis; and means for moving at least one of said blades across said path so that said blades separate the leader from the next-following portion of the rod while said blades are being moved by said transporting means, said moving means comprising two discrete cams, one for each of said blades, and follower means provided on said blades and tracking the respective cams, each of said cams constituting a hollow cylinder and said cylinders having axes which coincide with said predetermined axis and end faces which are tracked by the respective follower means.

14. In a machine having means for producing a continuous rod wherein a rod-like filler of fibrous material is surrounded by a tubular wrapper, means for conveying the rod lengthwise along a predetermined path and in a predetermined direction, and means for severing the rod at predetermined intervals downstream of said producing means to thereby subdivide the rod into sections of desired length, the improvement which consists in the provision of an apparatus for separating the leader from the next-following portion of the rod intermediate said producing means and said severing means, said apparatus comprising a cutting implement having two blades normally located at the opposite sides of said path; means for transporting said blades so that said blades have a component of movement in said direction; and means for moving at least one of said blades across said path toward the other blade so that said blades separate the leader from the next-following portion of the rod while said blades are being moved by said transporting means, including follower means provided on said one blade and cam means tracked by said follower means while said blades are being moved by said transporting means whereby said cam means causes said one blade to move across said path.

* * * * *